US005612675A

United States Patent [19]

Jennings et al.

[11] Patent Number: 5,612,675

[45] Date of Patent: Mar. 18, 1997

[54] ANTI-REMOVAL MONITORING DEVICE

[75] Inventors: Charles R. Jennings, Sioux City, Iowa; Sidney C. Oakleaf, Sioux Falls, S. Dak.

[73] Assignee: Intellitech International, Inc., Sioux City, Iowa

[21] Appl. No.: 589,894

[22] Filed: Jan. 23, 1996

Related U.S. Application Data

[63] Continuation-in-part of Ser. No. 133,326, Oct. 8, 1993, abandoned.

[51] Int. Cl.[6] ..... G08B 23/00

[52] U.S. Cl. ..... 340/573; 340/539; 455/100

[58] Field of Search ..... 340/573, 568, 340/572, 574, 539; 455/100; 200/43.16, 43.19, 43.11, 43.13, 512; 361/752

[56] References Cited

U.S. PATENT DOCUMENTS

| | | | |
|---|---|---|---|
| 3,478,344 | 11/1969 | Schwitzgebel et al. | 340/539 X |
| 4,694,284 | 9/1987 | Leveille et al. | 340/573 X |
| 4,736,196 | 4/1988 | McMahon et al. | 340/573 |
| 4,812,823 | 3/1989 | Dickerson | 340/572 |
| 4,973,944 | 11/1990 | Maletta | 340/573 X |
| 4,980,671 | 12/1990 | McCurdy | 340/539 X |
| 5,032,823 | 7/1991 | Bower et al. | 340/573 X |
| 5,117,222 | 5/1992 | McCurdy et al. | 340/573 |

*Primary Examiner*—Thomas Mullen

*Attorney, Agent, or Firm*—Henderson & Sturm

[57] ABSTRACT

An anti-removal monitoring device which may be strapped to a person's appendage or to a piece of equipment. Once activated, the device transmits a signature encoded RF signal distinguishable from others to be monitored by a receiving station. If either the person or the device moves or is removed to a range out of signal reception, or if tampered with as by cutting the strap, such alteration of the normal signal is detected at the receiving station. The device comprises, in one embodiment, a transmitter housing for electrical connection to a base in a manner sealing the connection against the elements, and with a biased piston movably mounted within the base for operative connection with both ends of the strap and for activation of the transmitter only upon completed securement of the strap ends about the appendage or equipment and into the base. In a second embodiment, the device comprises a transmitter housing for electrical connection to an intermediated base piece in a manner sealing the connection against the elements, and with a strap of which one end is mounted on the intermediate base and electrically connected to the transmitter through a switch, and with a locking base piece with a projection through a diaphragm for operative activation of an electrical switch for activation of the transmitter only upon completed securement of the strap ends about the appendage or equipment and between the intermediate base piece and the locking base piece, and for operative activation of another electrical switch for completing the tamper circuit from the strap to the transmitter.

17 Claims, 9 Drawing Sheets

ANTI-REMOVAL MONITORING DEVICE

This is a continuation-in-part of co-pending application Ser. No. 08/133,326, filed on Oct. 8, 1993, entitled ANTI-REMOVAL MONITORING DEVICE, now abandoned.

TECHNICAL FIELD

The present invention relates generally to high technology warning devices, and more particularly to an electronic signal and alarm protection proximity device applicable either to personnel or equipment.

BACKGROUND ART

Numerous technology warning devices have been disclosed in the prior art, such as shown in U.S. Pat. No. 4,694,284 entitled Abduction-Preventing Collar; U.S. Pat. No. 4,812,823 entitled Locked Transmitter Tag Assembly and Method of Lockably Attaching Same to Object; U.S. Pat. No. 4,973,944 entitled Electrical Signal Alarm Protection Proximity Device; U.S. Pat. No. 5,032,823 entitled Secure Personnel Monitoring System; and 5,117,222 entitled Tamper Indicating Transmitter.

Whereas each of these prior art devices discloses one or more features of the genus of this type of warning devices, i.e., a transmitter-held strap arrangement for securement to a person or a piece of property, and wherein an identifiable signal is emitted under certain circumstances from the transmitter, and wherein further the signal is altered in one manner or another upon certain movement of the person or equipment, or upon certain tampering of the device, each such prior art device has either such failings or requires certain improvements which are identified by the instant invention as described hereinafter.

DISCLOSURE OF THE INVENTION

The instant anti-removal monitoring device invention comprises a housing which has an electronic circuitry enclosed therein for transmitting a signal to a location remote from the device, the housing including further a switch, which may be a thin membrane, operable upon movement to activate the circuitry; an electrically conductive strap adapted to be wrapped around the limb of a person being monitored or about any part of a piece of equipment to guard against movement; a base for fixed physical attachment to the housing, and having a first passage including a pair of posts for receiving and holding one end of the strap inserted within the base, the transmitter electrically wired to the strap one end for transmitting current through the strap upon activation of the circuitry; the base including further a second passage for receiving the opposite end of the strap to form thereby a loop about the base for encircling either personnel or equipment accordingly, and including further a spring biased piston movable from a lowered, first position within the base to a raised upper position therein, the piston extended through both the inserted ends of the strap within the base and engaged with the switch to activate the electronic circuitry in the raised, second position.

Further, a locking device is provided to be inserted into the base for temporarily holding the piston in its lowered position, and a shaft element may also be insertable into the base for engagement with the piston to move it between the first and second positions; and additionally the first passage adapted to have applied thereto a sealing element for both sealing the strap one end and electrical connections from the elements and sealing the transmitter in a permanent bonded engagement with the base.

A modified embodiment of the invention shown in FIGS. 12–23, also has a housing for fastening to an intermediate enclosure and a base. Between the housing and the intermediate enclosure a transmitter PCB with battery components and a switch unit including a switch/interface PCB are secured with one free end of an electrically conductive strap attached and held between the base and the intermediate enclosure, and with the opposite strap end held between the intermediate enclosure and the housing, the strap end having connections extended through, in a sealed manner, a slot formed in the intermediate enclosure for electrical connection to the switch/interface PCB. Similar to the initial embodiment of FIGS. 1–11, the switch unit includes a piston, or plunger in this instance, mounted on the base and operable upon connection of the free end of the strap with the base, thus embracing at least part of that to be monitored, to move a diaphragm and to engage via the diaphragm a switching element part of a transmitter unit, thus activating the transmitter unit. The diaphragm protects the switching element against corrosion.

The transmitter unit has the capability of sending out RF signals to a central receiving unit for indicating the condition of the battery(ies), for identifying the specific device being monitored, and if the device is tampered with—such as a cutting or severing of the strap or a separation of the housing—base units, for detecting and signaling the tampering action. Further, if the device is moved outside of a specified range of signal strength, which action is also detected at the receiving station due to a loss of signal, upon a return of the device back into the range or zone of signal detection, not only is that action received by the central receiving station, but any tampering of the device even while outside the range will be indicated by the memory of the device.

This device in the form of a transmitter and bracelet has been designed to be used for various applications covering the offender program to the juvenile and nursing home applications. The purpose is to provide a cost effective way to monitor offenders, juveniles, patients, children and equipment either via a central station monitoring service or in house displays.

A primary object of this invention is to provide an improved anti-removal monitoring device.

Another object of the invention is to provide an anti-removal monitoring device which overcomes and eliminates current technological deficiencies in strap technology.

A further object of this invention is to eliminate the occurrence of false tamper signals due, for example, to corrosion of the conventional metal-to-metal electrical contacts.

Yet another object of this invention is to eliminate the need for installation tools such as screwdrivers and the like, with an installation kit providing all necessary elements.

Still another object of this invention is to provide an anti-removal monitoring device of a size comfortably worn on a wrist of a person of any age, such as not to be obtrusive to sight.

An additional object is to provide such an anti-removal monitoring device which is simple and inexpensive, yet easily assembled, durable and reliable in use.

Another object of this invention is to provide a monitoring device where any metal-to-metal connections and switches are completely sealed from the atmosphere, such that the device is not only tamper-proof, but waterproof.

Yet another object is to provide a monitoring device where the strap for encircling the object, or a part thereof, to be monitored is adjustable as to length of encirclement, but is also reusable.

It is another object of this invention to provide a monitoring device where the transmitter circuit is activated only at the time the monitoring device strap is wrapped around an object to be monitored and securely connected to the housing.

A further object is to provide a monitoring device where one end of the strap is inserted into a passage formed between the intermediate enclosure and the base, and which end is further inserted through a slot formed in the intermediate enclosure for electrical, sealed connection with the transmitter unit located above the intermediate enclosure.

BRIEF DESCRIPTION OF THE DRAWINGS

These and other attributes of the invention will become more clear upon making a thorough review and study of the following description of a preferred embodiment, particularly when reviewed in conjunction with the drawings, wherein.

BEST MODE FOR CARRYING OUT THE INVENTION

Figure 1:
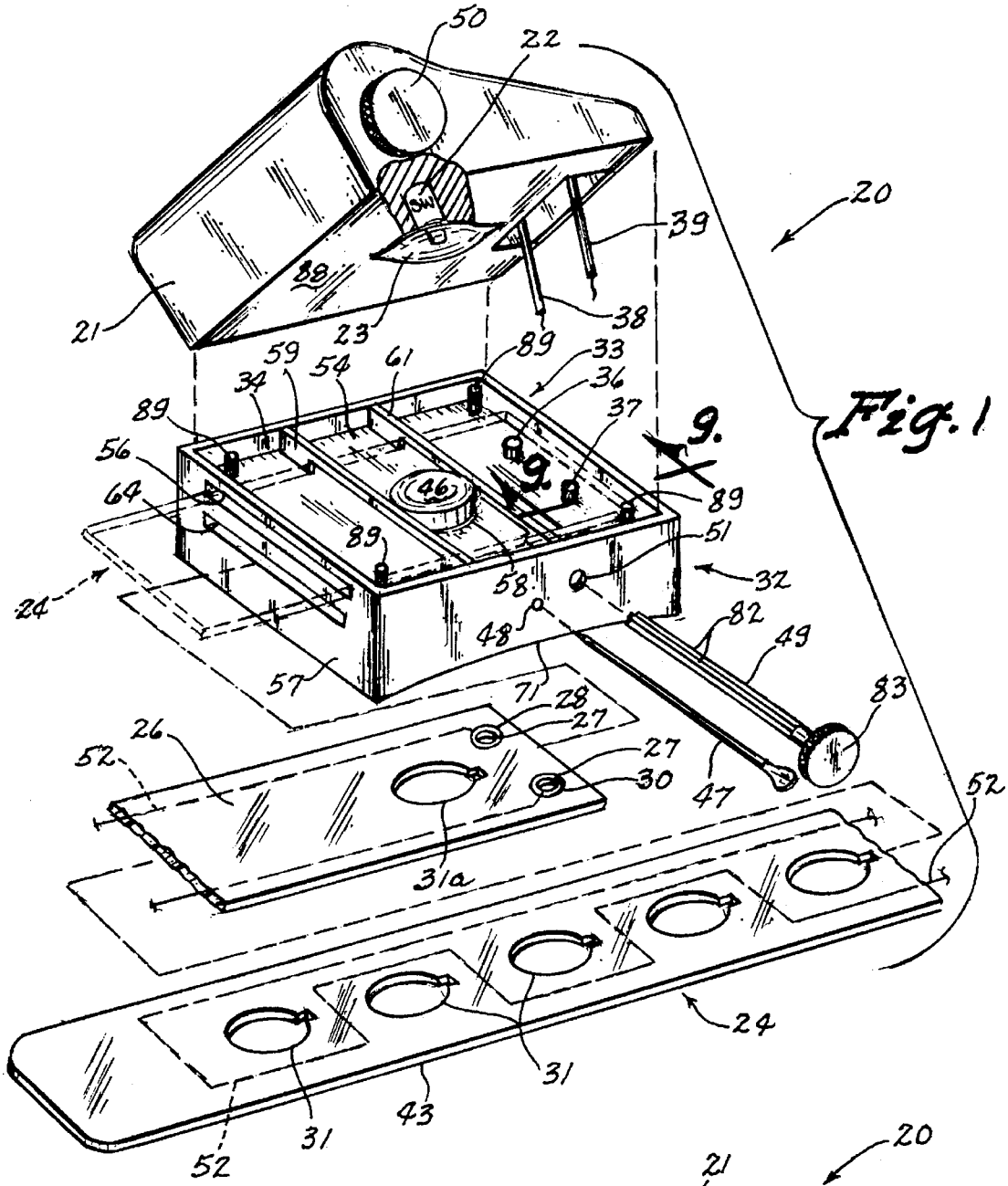
FIG. 1 is an exploded, perspective view of the anti-removal monitoring device of this invention certain parts fore-shortened and shown in section for clarity of illustration.

Referring now to FIG. 1, the anti-removal monitoring device of this invention is generally referred to at (20), and comprises generally a housing (21) having electronic circuitry enclosed therein for transmitting, as is conventional, a signal to a receiving station located remote from the device (20), the housing (21) including a switch (22) having a thin membrane (23) (see FIG. 5) operable upon movement to activate the switch (22) and to activate the electronic circuitry whereby to emit the signal. The device (20) includes further an electrically conductive strap (24) of a predetermined length, having one end (26) (FIG. 1) formed with a pair of spaced openings (27) (FIG. 9) with metal grommets (28), (30) inserted therein, and having an opposite free end (29), and having further a plurality of apertures (31) formed therein in longitudinal spaced relation.

Further, the device (20) comprises a base (32) for fixed and permanent attachment to the housing (21), and including a first unit (33) in the form of an upper passage (34) formed in the base (32) and having a pair of transversely spaced posts (36), (37) at one end of the passage (34) for receiving and holding the strap one end (26) which is electrically connected as by wires (38), (39) to the circuitry of the housing (21). The base (32) includes further a second unit (41) including a second, lower passage (42) formed in the base (32) for receiving opposite, free end (29) of the strap for adjustable securement within the base (32) as to the length of the loop (43) (FIG. 3), and with the base (32) also including a third unit (44) formed within the base (32) and having a biased piston (46) (FIGS. 4 and 5) movably mounted therein. The piston (46) has a dual capacity of moving from a lowered, first position (FIG. 5) to a raised, second position (FIG. 6) to first, engage the membrane (23) to energize the transmitter circuitry; and secondly, to pass through aligned apertures (31*a*), (31*b*) formed in the strap ends (26), (29), respectively, (FIG. 7) to aid in retaining the strap ends (26), (29) within the base (32) and against tampering.

Figure 5:
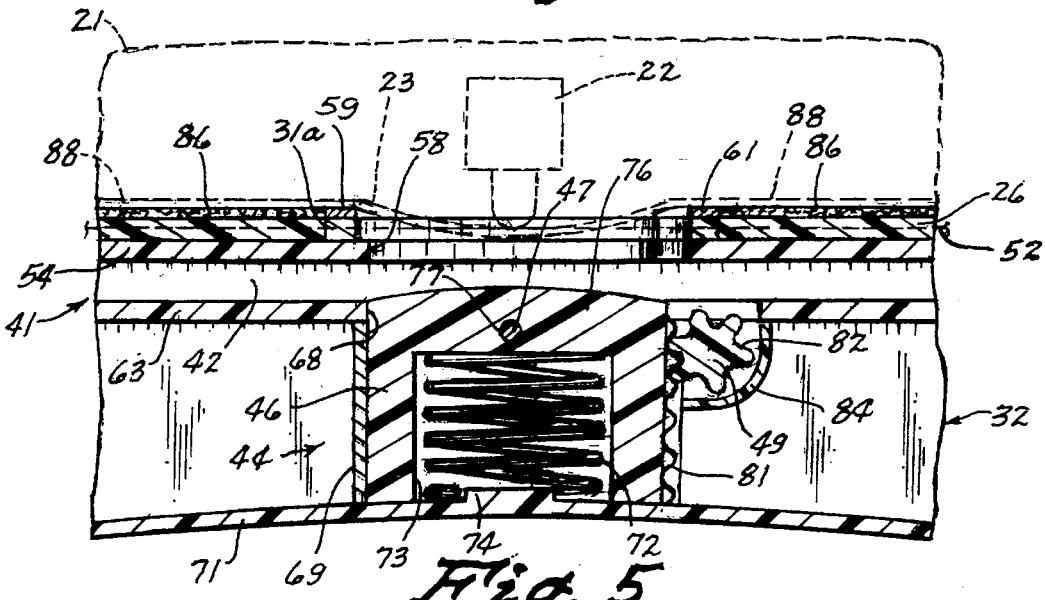
FIG. 5 is an enlarged, detail view of FIG. 4.

Additionally, a locking pin (47) (FIGS. 1 and 5) is provided for insertion through an opening (48) in the base (32) for insertion into the piston (46) for retaining the piston (46) in the lowered, first position; and a gear shaft (49) (FIGS. 1 and 5) is also provided for insertion through another opening (51) in the base (32) for engagement with the piston (46) in a manner described more in detail hereinafter to lower the piston (46) from the raised position (FIG. 7) to the lowered position (FIG. 5).

More particularly, the housing (21), fabricated out of molded plastic, not only has a cavity (not shown) formed therein for containing the electronic RF circuitry of the transmitter, but also has a cavity (not shown) for receiving one or more appropriate batteries for supplying the necessary source of power to operate the RF circuitry from whence the signal is emitted. A cover (50) is provided for the battery cavity for field replacement of the batteries. As stated hereinbefore, the electronic circuitry of the transmitter is not activated until the switch (22) (FIG. 1) is operated by movement, in this case inward or upward (see FIGS. 5 and 7), of the membrane (23) against the switch (22). Such operation of the switch then activates the transmitter circuitry. A signal frequency of 320 MHz range may be utilized, with an effective range of from 250 to 1500 feet, and signal transmission may be sent every minute for the receiving station (not shown) to analyze. Such transmission may include signals ranging from low battery detection, tamper of the device (20) detection, out-of-range and back-in-range detection of the device (20), and trouble restores on battery and tamper. Diagnostic signals may be randomly transmitted to the receiver verifying previous data in memory for any discrepancies. Priority alarm signals may be transmitted at the time of alarm while diagnostic signals are being transmitted at regular intervals.

The strap (24) may be made of conductive polyethylene, 4.5 cm. wide by 0.060 inches thick. An electric circuit path (52) is formed therein leading through the strap (24) from one grommet (28) to the free end (29) and back to the other grommet (30). Electrical connecting wires (38), (39) lead down from a cavity (53) formed in the housing (21) for connection with the grommets (28), (30), respectively, as by soldering (FIG. 9), such that upon energization of the electronic circuitry by activation of the switch (22), current flows through the entire length of the strap (24). Referring to FIG. 1, it will be noted that each aperture (31) formed in the strap has a key slot (54) formed as a part thereof, all slots (54) extended longitudinally of the strap (24) for a purpose described hereinafter.

Figure 10:
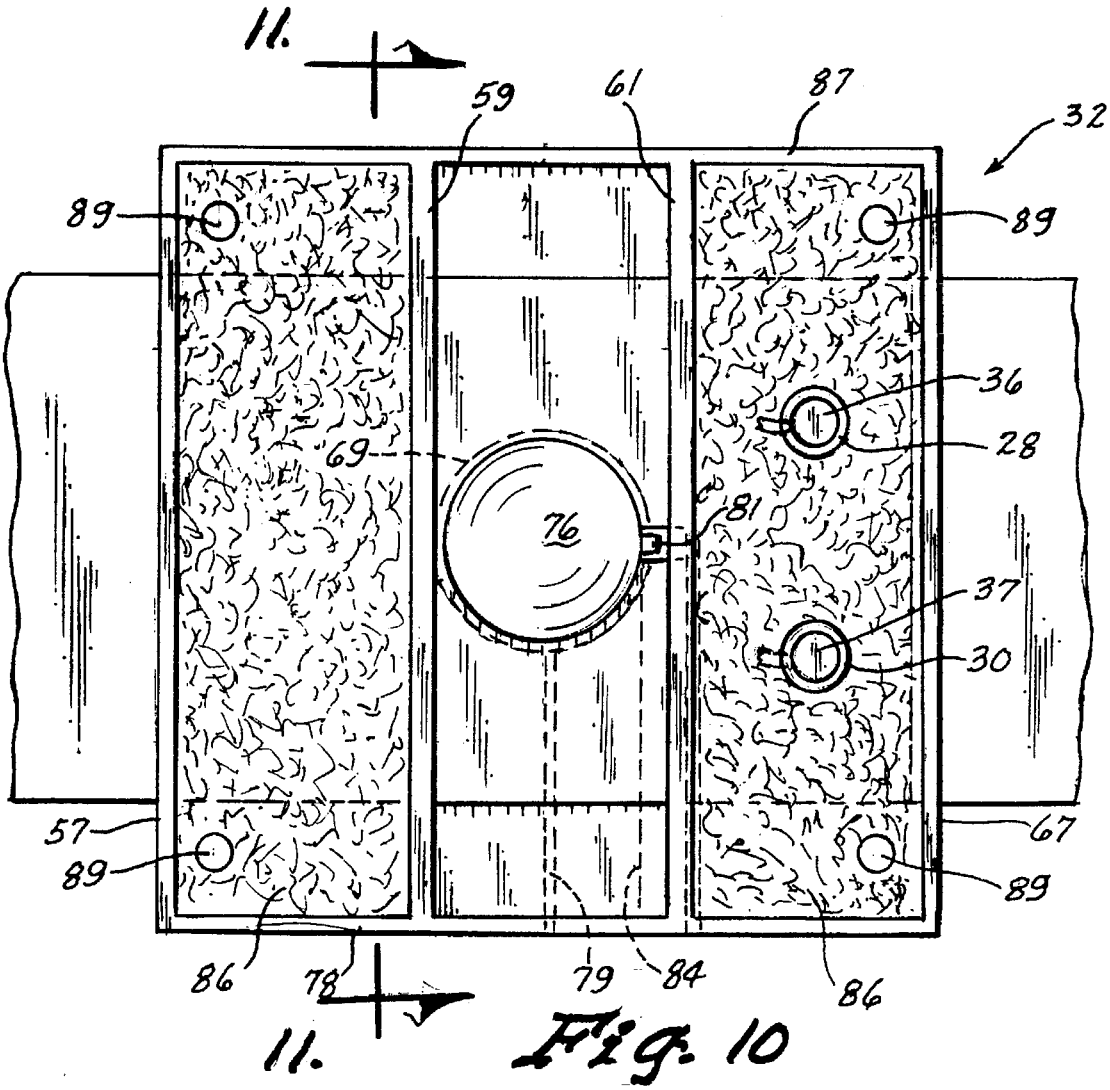
FIG. 10 is a plan view as taken along the line 10—10 in FIG. 6.

The base (32), like the housing (21), fabricated out of molded plastic, of one piece for example, comprises an upper floor (54) (FIG. 1) extending from end-to-end of the base (32), with a slot (56) formed in one wall (57) of the base (32) leading to the upper passage (34) above the floor (54), the pair of posts (36), (37) integral with the floor (54) at an end opposite the slot (56), and with a circular opening (58) (FIGS. 1 and 4) formed centrally within the floor (54) and sized to receive the piston (46). The slot (56) is also sized to receive the one strap end (26) with the spacing the posts (36), (37) and the floor opening (58) such that upon placing the grommets (28), (30) of the strap openings (27) over the posts (36), (37) the closest adjacent strap aperture (31*a*) is located directly over the floor opening (58) whereby the piston (46) is also movable through the aperture (31*a*). For a purpose described hereinafter, a pair of bridges (59), (61) (FIG. 1) are provided in longitudinally spaced relation on the upper floor (54), each with a cutout (62) space formed centrally therein as illustrated, the cut-out spaces (62) being sized to receive the strap one end (26) inserted therethrough (FIG. 10).

The base (32) includes further a lower floor (63) again with a slot (64) formed in the wall (57) below the slot (56) and with an opposite slot (66) (FIG. 4) formed in an opposite wall (67) whereby to form the lower passage (42) below the upper floor (54). A circular opening (68) is formed centrally in the lower floor (63) directly below the opening (58) in the upper floor (54), which opening (68) is sized to receive the piston (46). Both the slots (64), (66) and the passage (42) are sized to receive the free end (29) (FIGS. 6 and 7) of the strap (24). A cylinder (69) (FIGS. 5 and 10) is provided in a upstanding manner centrally of the base (32) between the lower floor (63) and the curved bottom wall (71) of the base (32), and has an inner circumference aligned with the inner circumference of the upper and lower floor openings (58), (68), respectively, all for slidably guiding the vertical, as viewed, movement of the piston (46) as it moves between its lowered (FIG. 5) and raised (FIG. 7) positions.

The third unit (44) includes not only the piston (46), but also a coil spring (72) (FIG. 5) mounted within a circular cavity (73) formed within the piston (46) and centered over a circular raised portion (74) formed on the base bottom wall (71). The spring (72) is under compression in the lowered position of the piston (46) (FIG. 5), and with the piston (46) free of the insertion therein of the locking pin (47) is operable to force the piston (46) upwardly within the cylinder (69) to the raised position, such as to engage the top (76) of the piston (46) with the membrane (23) and to move the membrane (23) and the actuator switch (22) upwardly as viewed in FIGS. 5 and 7 sufficient to energize the transmitter electronic circuitry. Referring to FIG. 5, it will be noted that the top (76) of the piston (46) has a raised, rounded surface which extends slightly above the surface of the lower floor (63) for a reason detailed hereinafter. To receive the locking pin (47), the piston (46) has a bore (77) (FIG. 5) formed therein of a predetermined depth, and to guide the pin (47) the guide (79) (FIG. 10) is formed within a side of the base (32) aligned with the bore (77) and with the opening (48) (FIG. 1) formed in a side wall (78) of the base.

Figure 2:
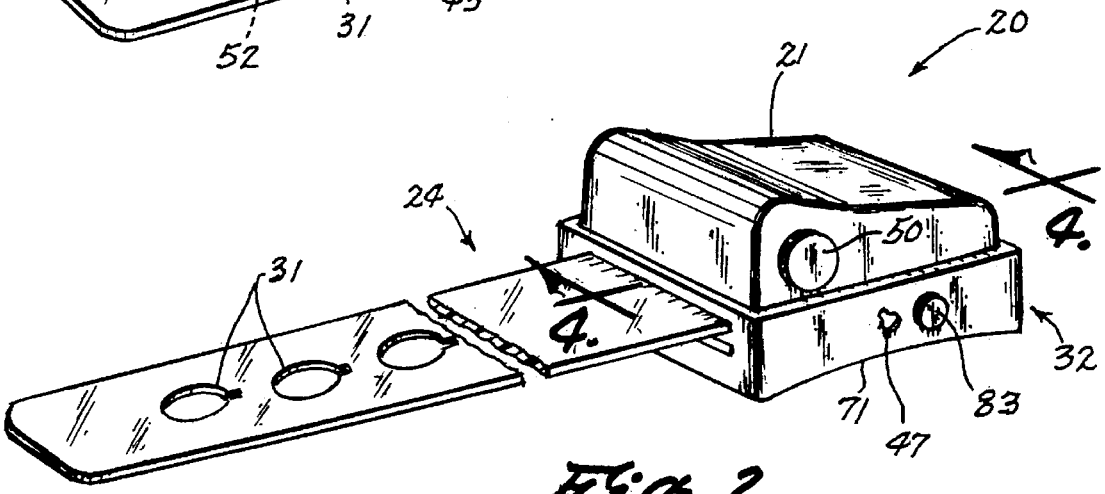
FIG. 2 is a perspective view of the device as partially assembled.
Figure 7:
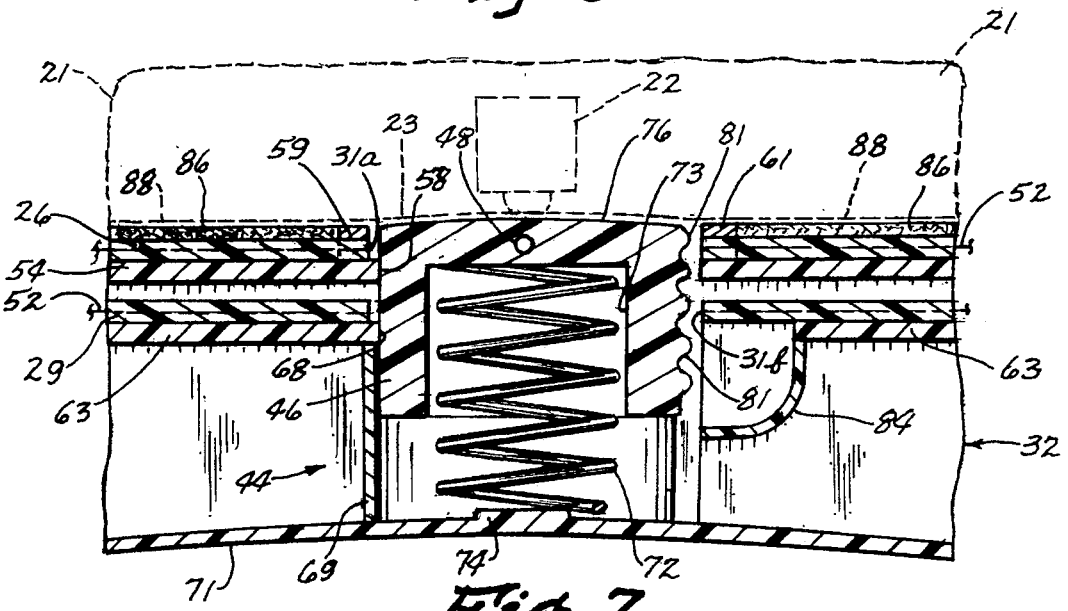
FIG. 7 is an enlarged detail view of FIG. 6.
Figure 8:
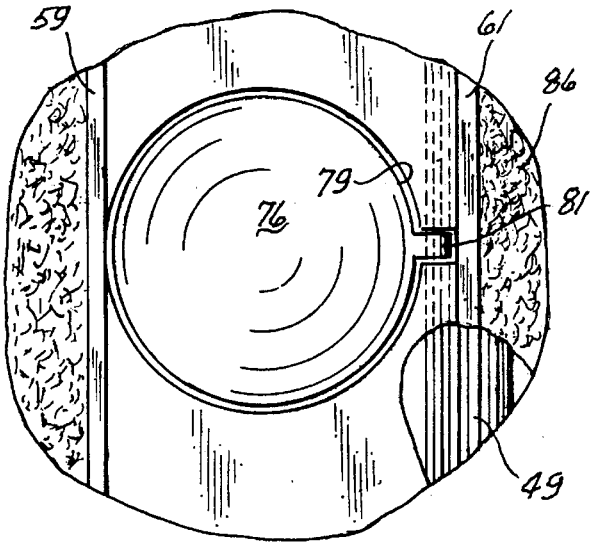
FIG. 8 is a plan view as taken along the line 8—8 in FIG. 4.

It will be appreciated that to move the piston (46) downwardly against the bias of the spring (72) when the base (32) is uncovered by the housing (21), any suitable object can be used to press downwardly against the top (76) of the piston (46) until it bottoms against the base bottom wall (71), at which time the locking pin (47) can be inserted through the opening (48) and into the piston bore (77) to lock the piston (46) in its lowered position. To provide for movement of the piston (46) against the bias of the spring (72), however, when the transmitter housing (21) has been affixed and otherwise secured to the base (32), the following provisions are made. On a side (79) (FIG. 8) of the piston (46) facing normal to the side wall (78) of the base (32), and facing in a direction aligned with the longitudinal extent of the strap (24) as it is inserted into the device (10), a set of gear teeth (81) (FIGS. 7 and 8) are formed in a vertical manner as viewed, and integral with the piston (46); thus the piston (46) having a key-slot appearance in plan (FIG. 8) similar in shape and slightly smaller in size than the apertures (31) formed in the strap so as to be capable of moving therethrough. Further, the guide cylinder (69) is relieved on one side to also accommodate the gear teeth (81) protruding outwardly from the circumference of the piston (46). With the key-slot apertures (31) formed in the strap (26) as described hereinbefore, the key-slot nature of the piston (46) enables the piston (46) to move through vertically aligned apertures (31), such as apertures (31*a*), (31*b*). The gear shaft (49) (FIG. 1) noted hereinbefore has splines (82) formed therein adapted for engagement with the teeth (81) upon insertion of the gear shaft (49) through the opening (51) formed in the side wall (78), such that upon appropriate rotation of the shaft (49) by the exposed knob (83) (FIG. 2), the piston (46) will be moved, for example, downwardly against the bias of the spring (72) from the normal, raised position to the lowered position (FIG. 5).

Again in this position of the piston (46), the locking pin (47) can be inserted to hold the piston (46) in the lowered position whereupon the gear shaft (49) may be withdrawn. To guide the shaft (49) as it is inserted into the base (32) and toward meshed engagement with the piston gear teeth (81), a curved, elongated panel (84) (FIGS. 5 and 10) is provided within the base (32) and below the lower floor (63). Thus, as needed, upon removal of the locking pin (47) from the base (32), the piston (46) is then moved back upwardly to its raised position (FIGS. 6 and 7) by action of the spring (72).

To assemble the anti-removal monitoring device, for example at the factory prior to being sent out for use in connection with personnel or equipment, the transmitter housing (21) would be complete with battery(ies) installed, switch (22) and membrane (23) installed (see the FIG. 5 position of same) and wires (38), (39) connected (FIG. 1). The transmitter housing (21) and all of its components would thus be ready for immediate energization as described hereinbefore for the creation and sending out of an RF signal.

Figure 6:
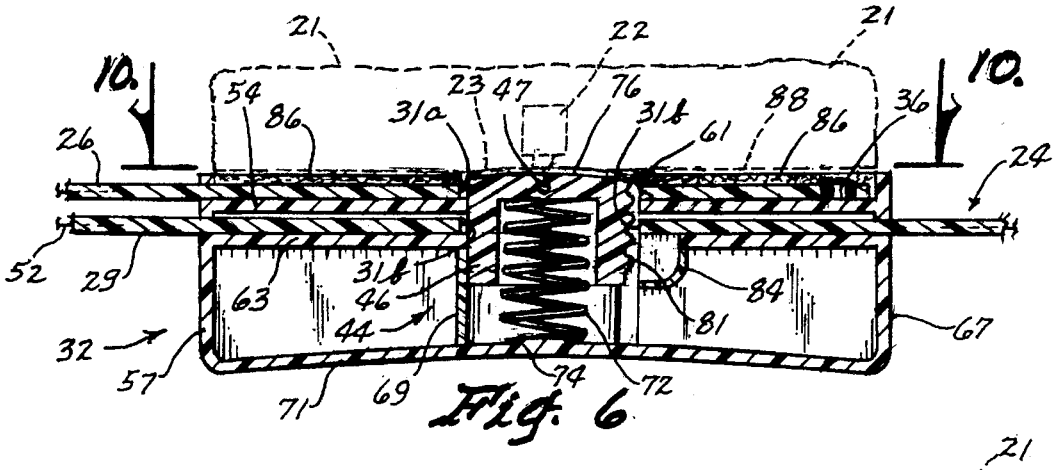
FIG. 6 is a sectional view as taken along the line 6—6 in FIG. 3.

All of the elements pertinent to the base (32) and heretofore described would be in place; the piston (46) and spring (72) disposed in their FIG. 6 position, the spring (72) having been inserted through the upper and lower floor openings (58) and (68), respectively into the cylinder (69), and then the piston (46) inserted in the same manner into the cylinder (69) and over the spring (72). The gear shaft (49) is then inserted through the wall opening (51) and the panel (84) into meshed engagement with the piston teeth (81) and the piston (46) is then compressed against the spring (72) and then held in the lowered position by insertion of the locking pin (47) as described hereinbefore.

With the piston (46) held down, the strap one end (26) is then inserted through the slot (56) and into the upper passage (34), through the bridges (59), (61) until the openings (27) with grommets (28), (30) can be placed over the two guide posts (36), (37), with the strap one end (26) then resting on the upper floor (54). The electric wires (38), (39) are then connected, as by soldering, to the grommets (28), (30) (FIG. 9), such that upon energization of the transmitter circuitry, current passes completely through the entire length of the strap (24) via the conductive path (52) formed therein. If desirable for testing purposes, with the transmitter housing (21) temporarily inserted into the base (32) (FIG. 2), the piston (46) may be released by removal of the pin (47) to ascertain if the piston (46) moves upwardly and engages the membrane (23) as designed. The shaft (49) would then again be inserted to ratchet—in effect, the piston (46) back downwardly to its lowered position. The transmitter housing (21) would then be separated from the base (32) but with the wires (38), (39) connected.

Figure 9:
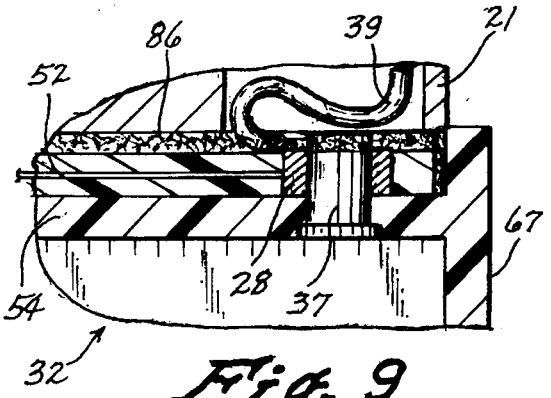
FIG. 9 is an enlarged sectional, detail view as taken along the line 9—9 in FIG. 1.
Figure 11:
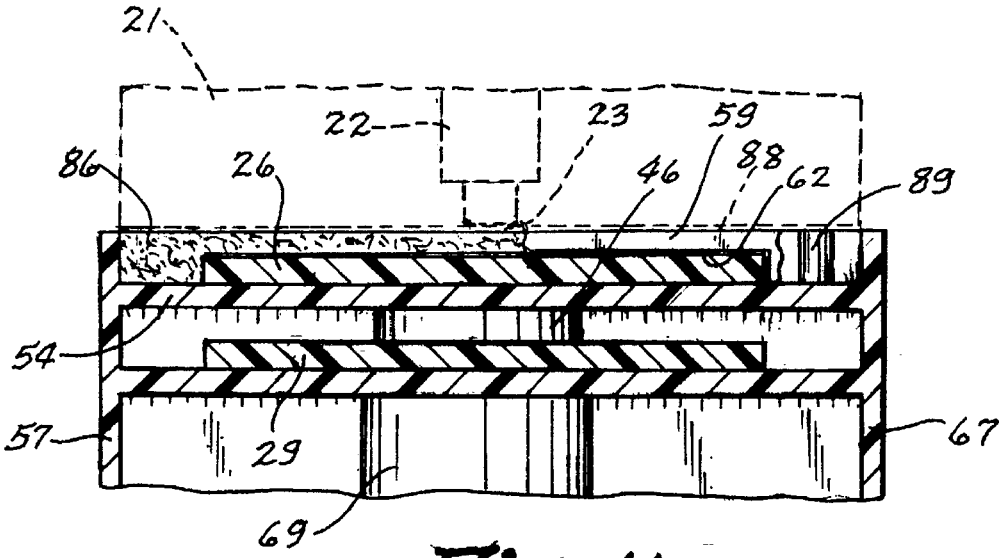
FIG. 11 is a sectional view as taken along the line in FIG. 10.

A sealant (86) (FIGS. 4, 10 and 11) would then be placed over the strap end (26) as between each bridge (59), (61) and the adjacent wall (57), (67) such as to completely seal over particularly the soldered connections of the wires (38), (39) to the strap grommets (28), (30) (FIG. 9). The sealant (86) is of a sufficient thickness such, that upon placing the transmitter housing (21) downwardly on and nested within the walls (57), (67), (78), (87) of the base (32), the bottom surface (88) (FIG. 1) of the transmitter housing (21) engages and is adhered to the sealant (86). To aid in a level seating of the transmitter housing (21) on the base (32), a plurality of pins (89) are formed on the upper floor (54), one placed in each upper corner, and the height of the pins (89) the same as the height of the bridges (59), (61) (FIG. 11). By this arrangement the device (20) may be submerged and otherwise exposed to the elements with the electrical connections to the strap (24) completely sealed to prevent false signals due to corrosion or the like. It will be noted that the bridges (59), (61) act as dams against the sealant (86) moving into the center area of the base (32), whereby to maintain the piston (46) movement clear of encumbrances. The device (20) then is in condition to be shipped to a user, with the locking pin (47) in place to hold the piston (46) in its lowered, inactive position (FIG. 5), and with the gear shaft (49) either in place or removed, as desired. This arrangement prevents premature battery usage and activation of the transmitter (21) when not in use.

Figure 3:
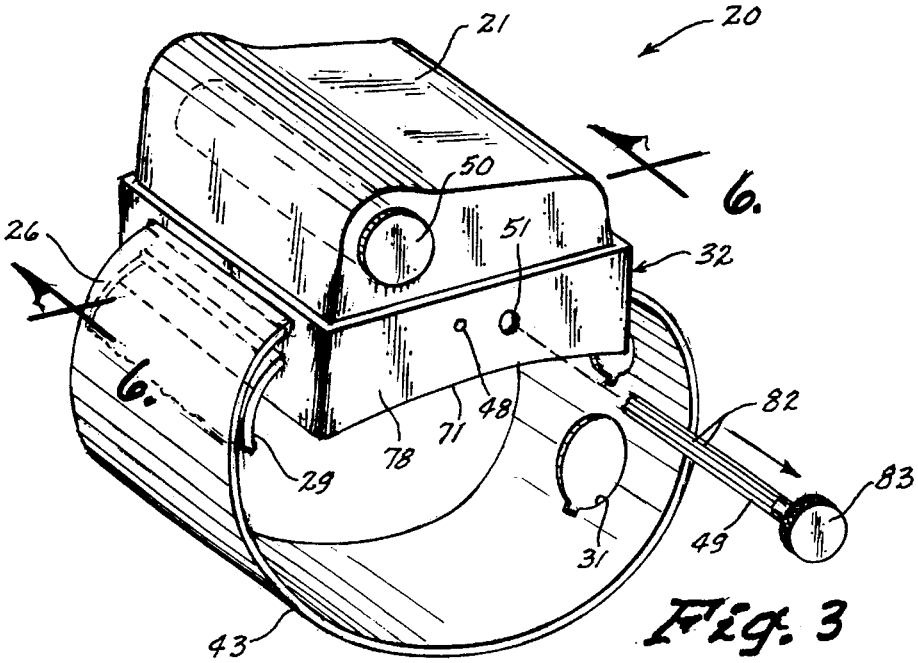
FIG. 3 is a perspective view, partly exploded, showing the device assembled for use.
Figure 4:
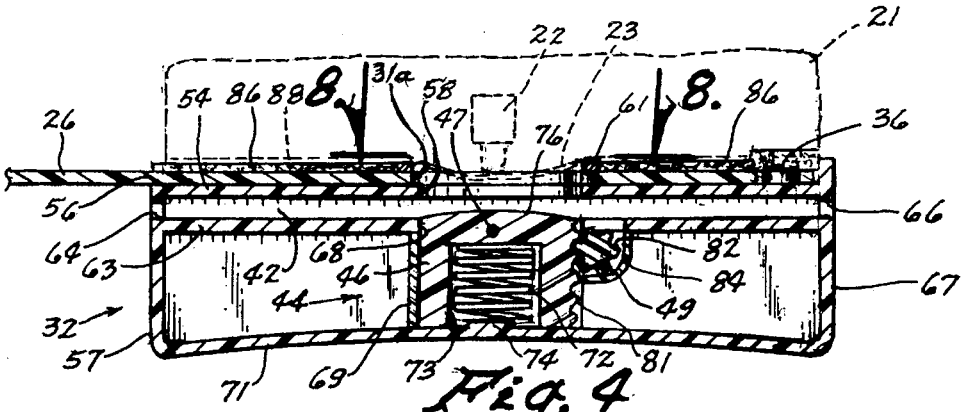
FIG. 4 is a sectional view as taken along the line 4—4 in FIG. 2.

At the location of use, the transmitter housing (21) will then be placed on a user's wrist or ankle, or placed on a piece of equipment by looping the strap (24) about the object of a length (FIG. 3) such that the object may not be withdrawn through the loop (43), and then the free end (29) of the strap (24) is inserted in the slot (66) (FIG. 6) and extended across the lower floor (63) and out the opposite slot (64) (FIG. 3). During this process, the strap (24) must be located within the lower passage (42) to place one of the apertures (**31*b*) (FIG. 7) for example, in vertical alignment with the lower central opening (68), and thus in vertical alignment with the upper central opening (58) and the strap one end aperture (31*a*) for free movement of the piston (46). This is aided by the piston top (76) (FIG. 8) being rounded and slightly raised above the surface of the lower floor (63) (FIG. 5), such that one may "feel" the alignment of an aperture (31) with the piston (46). The alignment may be tested by withdrawing the pin (47) while holding but raising the piston with the gear shah (49) to ascertain free upward movement of the piston (46). Alternatively, the piston (46) may be freed completely for upward movement, and then returned if necessary with a temporary activation of the transmitter (21**).

Once it is ascertained that the lower free end (29) of the strap (24) is properly fitted into the lower passage (42), the size of the strap loop (43) being properly adjusted, the shaft (49) and pin (47) are both removed, allowing the piston (46) to move upwardly by the spring (72), engage the membrane (23) and activate the transmitter circuitry via the switch (22), at which time the transmitter will immediately begin sending data to its assigned receiver. A receiver station will constantly receive, identify and monitor the one or more signals being emitted from the device (20). If the device (20) is taken either out of range from the station, or if the strap (24) is severed in an attempt to remove the person or the equipment from the predetermined range, the signal ceases to be received at the receiver station, and thus indication is given that the allowed proximity has been exceeded or the device tampered with.

The device (20), as a bracelet, may be removed from the person or equipment at any time by simply inserting the plastic shaft (49) into its guide panel (84) and into engagement with the piston teeth (81), lowering the piston (46), whereby the strap free end (29) can then be withdrawn from the base (32), the piston (46) again held down by the plastic locking pin (47).

Figure 12:
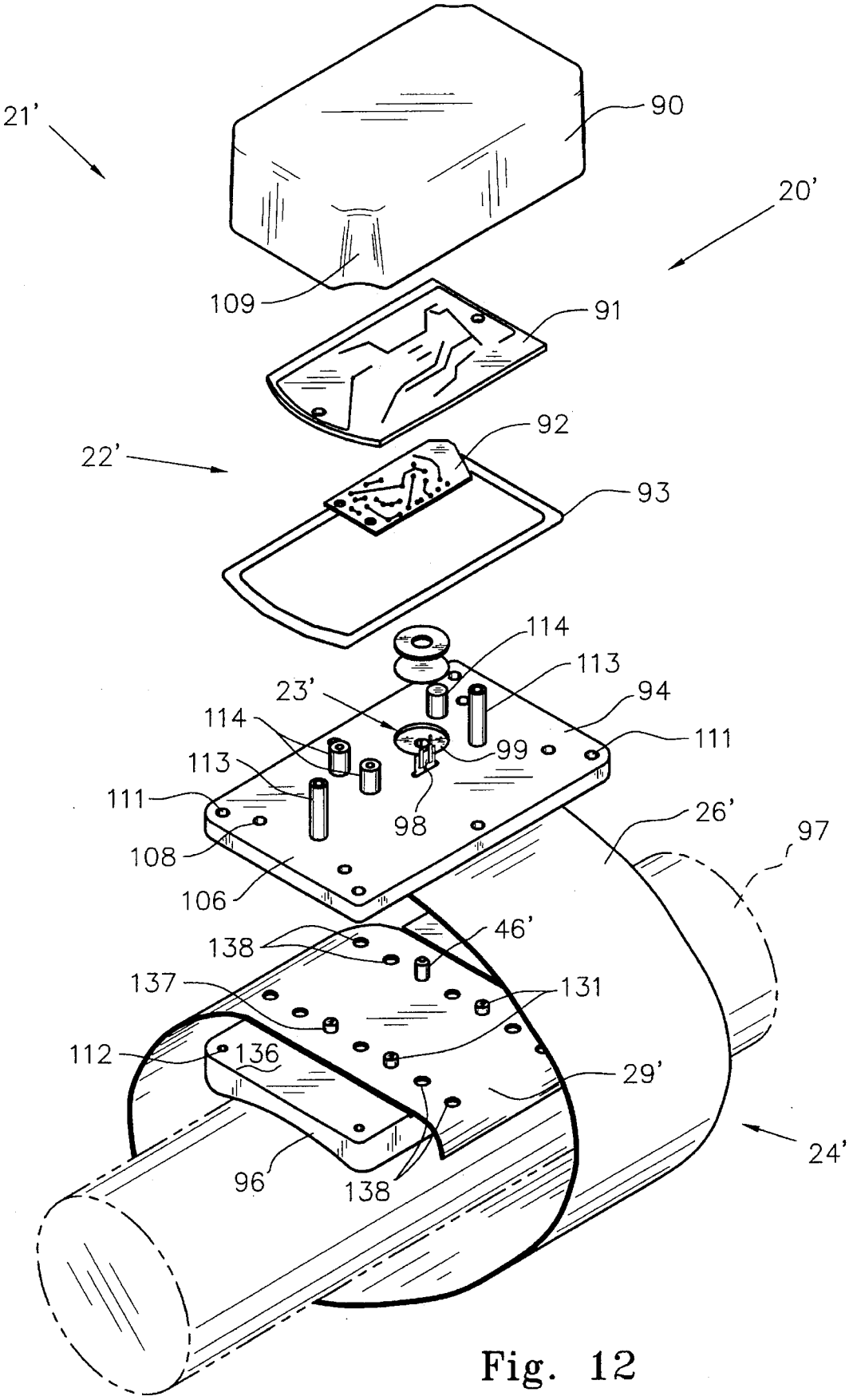
FIG. 12 is an exploded, perspective view of a modified embodiment of the anti-removal device of this invention, shown wrapped about an object illustrated by dash lines.
Figure 13:
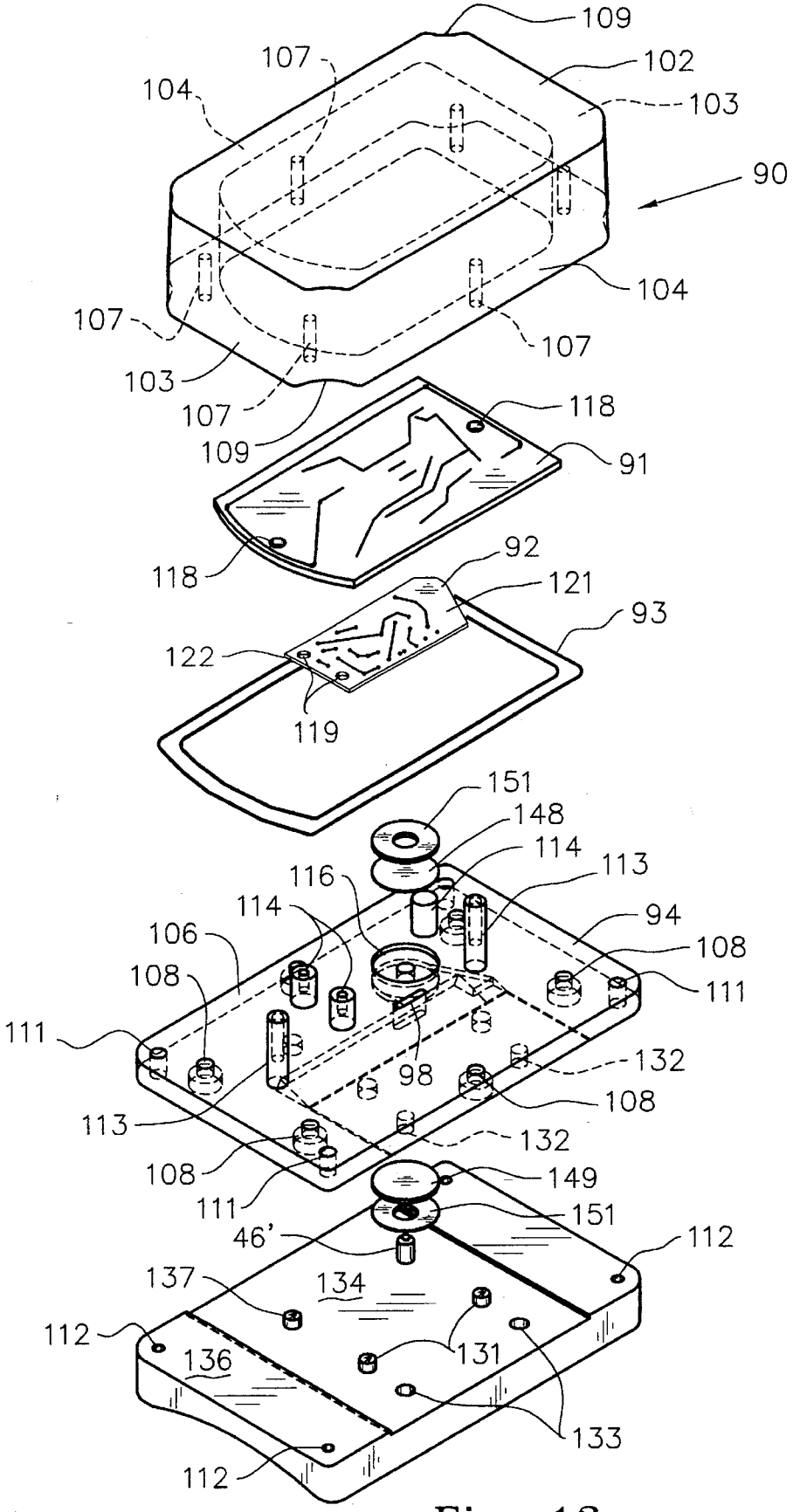
FIG. 13 is another exploded, perspective view of the device of FIG. 12, with certain elements shown in dash lines for clarity of illustration.

Referring now to FIGS. 12–23, and particularly FIGS. 12 and 13, a modified embodiment of the anti-removal device of this invention is referred to at (20'). To identify elements common with the embodiment of FIGS. 1–11, numerals with a prime indicator are used. As shown in FIG. 12, the modified device (20') comprises generally a housing (90), a transmitter/switch unit (22') including a transmitter printed circuit board (PCB) (91) and switch/interface PCB (92) either as two elements or as one, a double "O" ring seal (93), an intermediate enclosure (94), a base (96), and an electrically conductive strap (24') for encircling an object (97) to be monitored.

Under normal conditions, and as defined more in detail hereinafter, the housing (21'), the two PCB's (91), (92), the seal (93) and the intermediate enclosure (94) are secured together, with one end (26') of the strap (24') disposed beneath the enclosure (94) and extended through a slot (98) formed therein, with contacts (99) (FIG. 12) electrically connected to appropriate components of the switch/interface PCB (92) The housing (90), enclosure (94) and base (96) form a housing unit (21'). With the free end (29') of the strap (24') encircling the object (97) and connected to the upper face of the base (96), the base (96) is then securely connected to the enclosure (94) and the housing (21'). In so doing, a plunger (46') mounted on the base (96) is moved into engagement with the underside of a membrane or diaphragm unit (23') (FIG. 15) and moves upwardly into engagement with so as to flex and extend upwardly the diaphragm unit (23'), whereby the upper end (101) of the plunger (46') engages, via the unit (23'), appropriate components of the switch/interface PCB (92). The transmitter PCB (91) is then energized and appropriate signals and other electrical components activated for the purposes mentioned hereinbefore and as with the device (20').

More particularly, the housing (90) (FIG. 13) made preferably of molded plastic, is of a rectangular formation having a top (102), end walls (103) and side walls (104), forming a shell for fitting over and enclosing the transmitter PCB (91), the switch/interface (92), and resting on the upper face (106) of the intermediate enclosure (94). The walls (103) and (104) of the housing (90) are sufficiently thick to provide for passages (107) (FIGS. 13 and 16) formed therein for receiving tamper proof screw fasteners (not shown) inserted upwardly through openings (108) formed in the enclosure (94) with "O" rings, thereby securing the housing (90) and enclosure (94) together. Prior to actual fastening of the housing (90) and enclosure (94), the double "O" ring seal (93) is placed over lower face of the housing end and side walls (103), (104) and is sized to fit on both an inside perimeter and an outside perimeter about the exposed ends of the passages (107). Recesses (109) (FIGS. 13 and 16) are formed in the corners of the housing walls (103), (104) to enable tamper proof screws (not shown) to be inserted downwardly through corner passages (111) in the intermediate enclosure (94) and into openings (112) provided therefor formed in the base (96).

Figure 14:
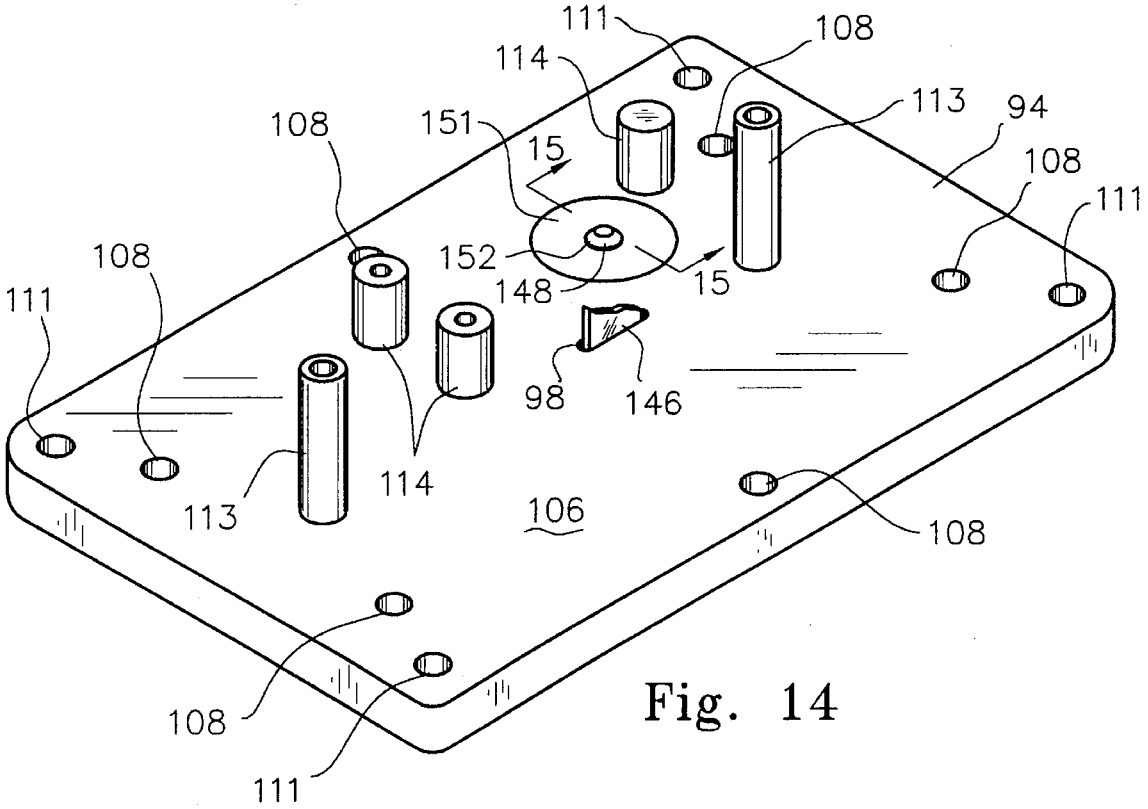
FIG. 14 is an enlarged perspective view of the intermediate enclosure of FIG. 12, and showing a portion of the fixed end of the strap protruding through a slot formed therein.
Figure 15:
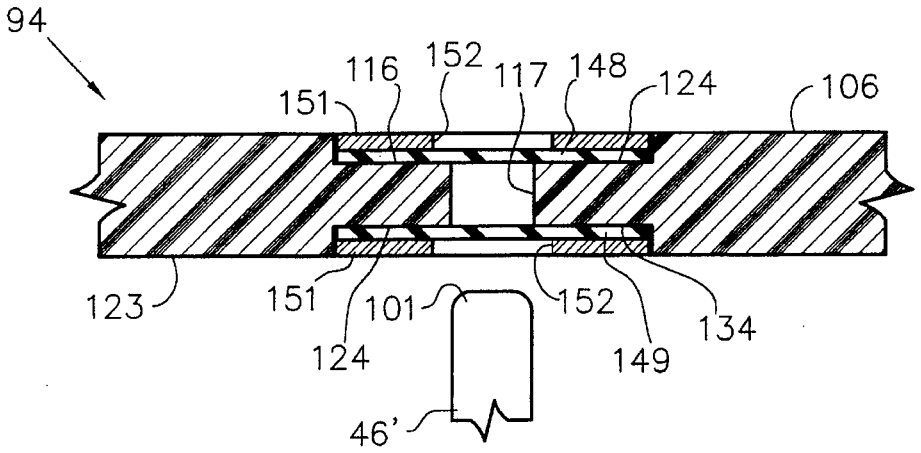
FIG. 15 is an enlarged, foreshortened sectional view taken along the line 15—15 in FIG. 14, and showing the redundant diaphragm unit for receiving the plunger of this device.
Figure 16:
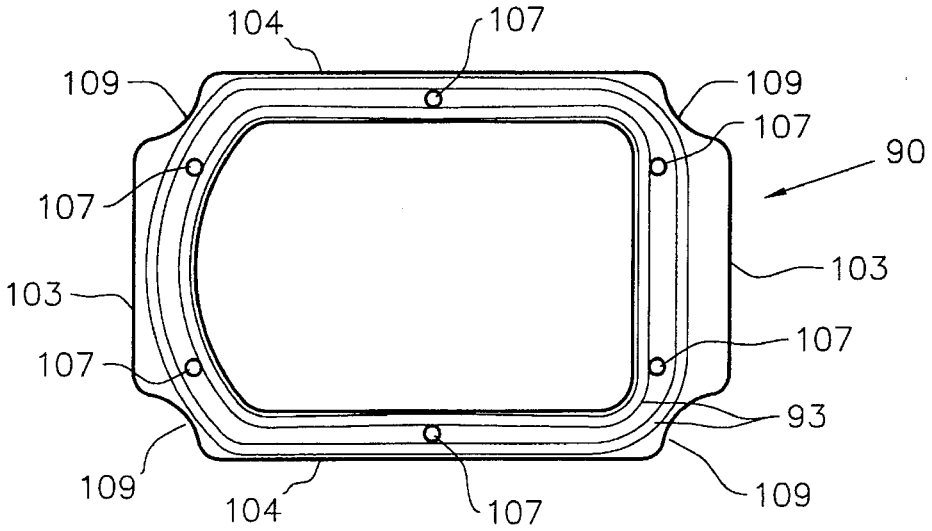
FIG. 16 is a plan view of the underside of the housing with the seal applied thereto, the elements found separated in FIG. 12.

Referring particularly to FIGS. 13 and 14, the intermediate enclosure (94) is of a rectangular formation, also preferably of molded plastic, and is provided on the upper face (106) with a pair of elongated posts (113) spaced lengthwise on the enclosure (94) as illustrated a trio of shorter posts (114) spaced triangularly as shown, and a circular depression (116) (see also FIG. 15) with an opening (117) centrally of the depression (116) and extended through the enclosure (94). The posts (113) are internally threaded to receive screws (not shown) inserted downwardly through openings (118) formed in the transmitter PCB (91) for connecting the PCB (91) onto the posts (113). At least two of the shorter posts (114) also are threaded internally to receive screws (not shown) inserted through openings (119) formed in the switch/interface PCB (92), the other post (114) acting as a support for the PCB (92), but importantly providing for a slight flexibility of movement of the end (121) of the PCB (92) relative to the fixed end (122). As mentioned before, a slot (98) (FIG. 14) is formed in the enclosure (94) through which an end (26') of the strap (24') may protrude therethrough.

Figure 17:
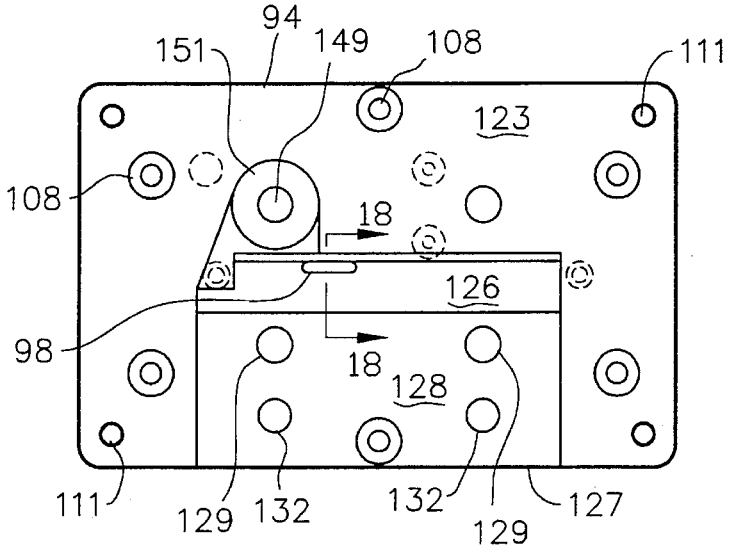
FIG. 17 is a plan view of the underside of the intermediate enclosure of FIGS. 13 and 14.
Figure 18:
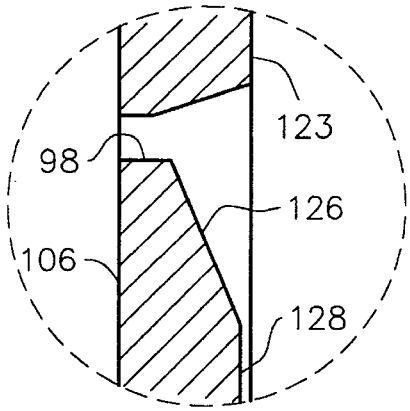
FIG. 18 is a greatly enlarged, detail sectional view of the slot of the intermediate enclosure, as taken through the line 18—18 in FIG. 17.

On the underside face (123) (FIGS. 15, 17 and 18) of the intermediate enclosure (94), a circular depression (124) (FIG. 15) is formed directly opposite the depression (116), a V-groove (126) (FIG. 18) is formed opposite the slot (98), extended toward one edge (127) of the enclosure (94) and with a slight depression (128) milled into the face (121) and extended completely to the edge (127). As best shown in FIG. 17, the V-groove (126) and depression (127) form a rectangular shape as seen in plan, the width of which is sufficient to receive the strap end (26') and the depth of which is such that as the strap end (26') is placed on the depression (127) its width does not extend beyond the face (123).

Within the rectangular shape of the depression (127), a pair of spaced openings (129) are formed in the intermediate enclosure (94) to receive connecting posts (131) formed on the base (96) (FIG. 13), and also a pair of spaced posts (132) are formed to be inserted into openings (133) formed therefor in the base (96). The base (96) is also of a rectangular shape similar to the intermediate enclosure (94), is preferably of molded plastic, has a concavity formed on its underside to accommodate a like curvature of the object (97) being monitored and has a depression (134) (FIG. 13) milled completely across its upper face (136) to receive the strap free end (29'). An additional pair of posts (137) are provided in spaced relation, one post (46') being taller than the other (137) and functioning as the plunger (46') as described herein. One set of posts (137), (131) and openings (133) is aligned (FIG. 13) as is the other identical set to match with like aligned and spaced openings (138) (FIG. 20) formed in the strap free end (29') whereby the strap free end (29') (FIG. 12) can be placed at any desired longitudinally adjusted position on the base (96), such that the longitudinally spaced and laterally aligned openings (138) mate with the posts (131), (137), the plunger (46') and with the openings (133) (FIG. 13) and intermediate enclosure posts (132) prior to assembly.

The strap (24') (FIGS. 12, 20, 21) has a preferable length of approximately seventeen inches, although of course that can be varied, and a preferred width of approximately two inches. It has a conductive pattern as illustrated of a flexible silver filled polymer (139) with a resistance of 0.015 OHM/SQ/MIL or less. The polymer (139) is covered on one side with a polyester base material (141), and on the other side with an opaque, polyester overcoat (142), each covering preferably of a minimum thickness each of 0.005 inches the finished article being flexible. To render the conductive pattern invisible to the naked eye, the sides of the overcoat (142) and base (141) facing the polymer (139) are covered with a black UV ink (not shown). A dielectric layer (144) may be provided, if needed, under the overcoat (142).

At the tab end (146) of the strap end (26') to be fixed, a pair of pins (99) are connected as by soldering to the polymer (139) and provides for the electrical connection to the PCB (92). Also at the strap end (26') (FIG. 20) a quartet of openings (138') are provided for matching with posts (131) (FIG. 13) and openings (133) of the base, and associated posts (132) and openings (129) on the underside of the enclosure (94) so as to ensure connection of the end (26') into the depression-type passages (128) and (134) formed respectively in the enclosure (94) and base (96) respectively.

As part of the switch unit (22'), the diaphragm unit (23') (FIGS. 13 and 15) comprises a pair of circular membranes (148), (149) placed in the circular depressions (124), (134), respectively, and held in place by a sealing adhesive material and a pair of diaphragm retainers (151), each retainer having an opening (152) formed therein such that only the membranes (148), (149) separate the plunger top end (101) from engagement with appropriate switches (153), (154) (FIG. 22) on the switch/interface PCB (92). The membranes (148), (149) are preferably of a thin latex rubber.

The transmitter PCB (91) is an off-the-shelf product commercially available from Interactive Technologies, Inc. (III) of Minneapolis, Minn. and is identified by Part Number ITI 55-662-B. The functions are the same as those of the transmitter described hereinbefore as to the device (20). On the underside (not shown) of the PCB (91) one or more battery components—preferably lithium (156) (FIG. 22) are provided for supplying power to the transmitter components.

Figure 19:
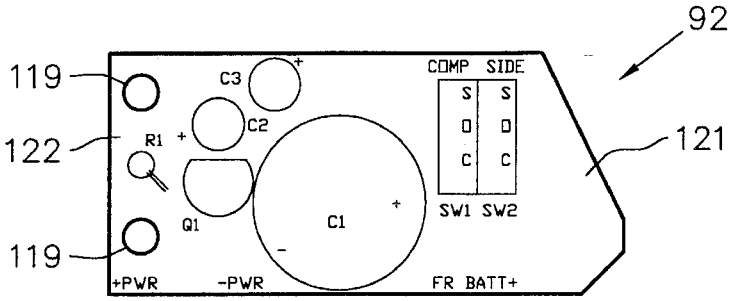
FIG. 19 is an enlarged view of the underside of the switch/interface PCB of FIG. 12.
Figure 20:
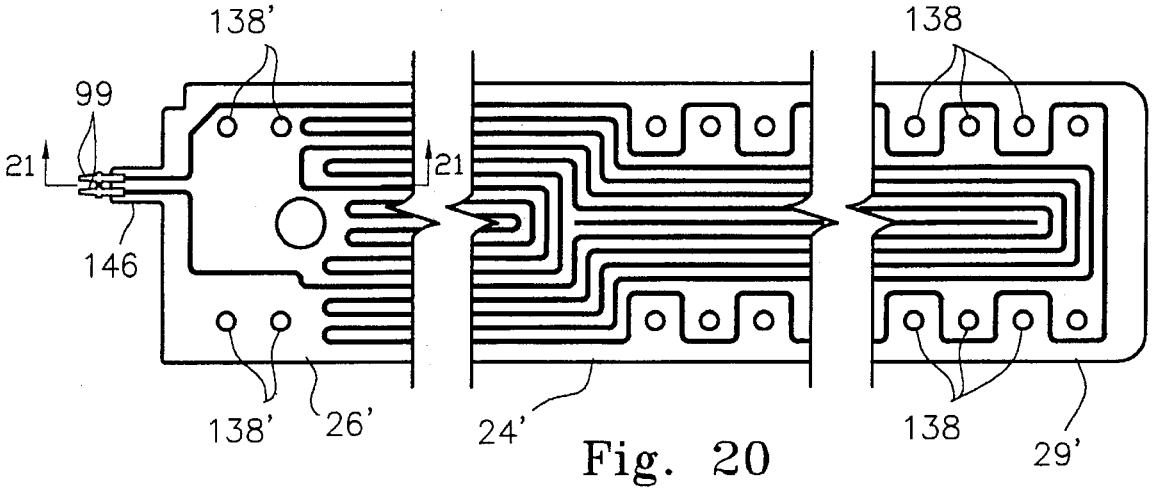
FIG. 20 is an enlarged foreshortened plan view of the electrically conductive strap.
Figure 21:
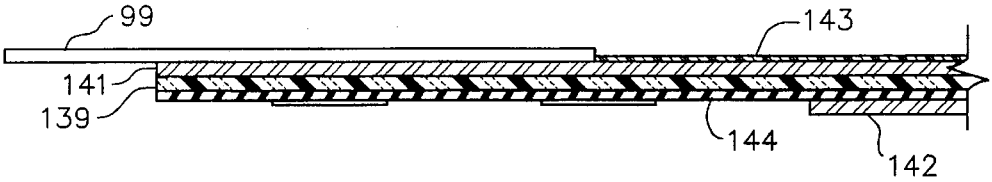
FIG. 21 is a magnified, detail sectional view of the strap as taken along the line 21—21 in FIG. 20.
Figure 22:
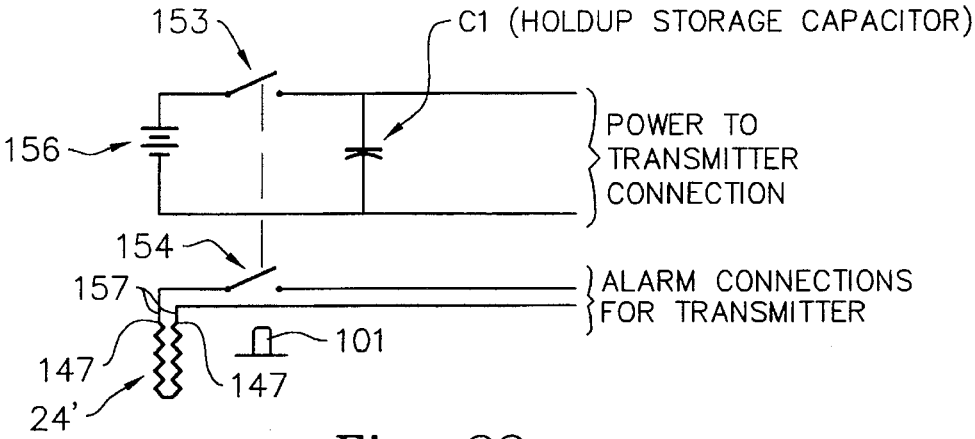
FIG. 22 is a block circuit diagram of components for ensuring a tampering signal delivered even though the battery has been disconnected by the switch as a result of tampering with the housing.

Referring now particularly to FIG. 19, the underside components of the switch/interface PCB (92) are illustrated. The switch/interface PCB (92) is manufactured by Dynage Division, Division of Oakleaf, Inc. and is identified as Dynage Part Number 03B644. The PCB (92) serves three functions as follows: A. Battery Disconnect Switch & Holdup Storage Capacitor. Switch SW1 (153) is a normally-open single pole switch which disconnects the battery (156) from the load (circuitry) when the monitor (20') is not mounted on the person or equipment to be monitored. In the process of mounting the monitor (20') on the person or equipment to be monitored, this switch (153) is closed when the monitor (20') is assembled as described hereinbefore, and feeds power from the battery (156) to the holdup storage capacitor (C1) and to the transmitter PCB (91) (load circuitry) downstream of the holdup storage capacitor (C1). Switch SW1 (153) and switch SW2 (154) are actuated simultaneously by the common actuating plunger (46') on the intermediate enclosure (94). With the opening of switch SW2 (154) as described below, it is necessary that the transmitter PCB (91) send a tamper alarm but with switch SW1 (153) opening at the same time, and disconnecting the battery (156) from the transmitter PCB (91), the transmitter (91) will be disabled; hence, it is necessary to have holdup storage capacitor C1 in the power circuit with enough stored energy to operate the transmitter (91) for a sufficient period of time after opening of switches SW1 (153) and SW2 (154) to permit the transmitter (91) to send the tamper alarm described below.

B. Tamper strap disconnect switch. Switch SW2 (154) is a normally-open single pole switch which opens the tamper strap circuit when the base (96) part, with its actuating prong (46'), is illegally loosened or removed from the intermediate enclosure (94) after having been initially installed on the person or equipment to be monitored. The opening of this switch SW2 (154) will have the same effect of initiating a tamper alarm by the transmitter (91) as would the cutting of the tamper strap (24'). Thus, the purpose of the switch SW2 (154) is to indicate that illegal disassembly of the monitor device (20') is taking place and a tamper alarm will be initiated by the transmitter PCB (91).

C. Modification of the Transmitter Transmission Time Interval Circuitry—the four electronic components, namely transistor Q1 (FIG. 19), resistor R1, capacitor C2, and capacitor C3 are interconnected on the switch/interface PCB (92) in such a way and wired to the transmitter PCB (91) in such a way as to effect a time interval between each transmission by the transmitter (91) of one (1) minute. Although shown separately, this circuitry may be incorporated into the transmitter PCB (91) such that a separate PCB (92) is not necessary. As presently designed, the soldered lines on the upper face of the switch/interface PCB (92) are connected as by electrical wires (not shown) to the appropriate components on the transmitter PCB (91).

Prior to use, as mentioned hereinbefore, the end (26') of the strap (24) is located on the underside of the intermediate enclosure (94), utilizing the depression (128), openings (129) and posts (132) with the strap openings (138). and the tab end (146) is inserted upwardly through the V-slot (126) such that it (146) and the pins (99) protrude upwardly through the slot (98). The pins (99) are then electrically connected to connections (157) (FIG. 22) as part of the switch interface PCB (92). A sealant (not shown) is then applied within the V-slot (126) to seal the open slot (98) and to adhere the strap end (26') securely to the enclosure (94). The housing (90), and the intermediate enclosure (94) with enclosed components (91), (92) and (93) are then connected together.

The strap (24') can then be adjustably wrapped about the object (97) being monitored, with the free end (29') affixed to the upper face depression (134) and the appropriate posts (131), (137) and the plunger (46'). Upon connecting and securing the intermediate enclosure (94) to the base (96), the height of the plunger causes its upper end (101) to extend through the lower retainer hole (152), engage the lower membrane (149), extend the membrane (149) upwardly through the enclosure opening (117) and to engage and flex upwardly the upper membrane (148) through the upper retainer opening (152) a sufficient distance until both tactile switches (153), (154) are engaged and switched on, thus activating the entire transmitter and switch assembly (91), (92). Should one membrane (148) or (149) tear for any reason, the other would still function as intended. In the non-use condition of the device (20') where the strap free end (29') is unattached to the housing (21') as the transmitter and switch assembly (91), (92) are not activated, the battery (156) is not in use, thus there is no power drain on the system.

It can thus be seen that an anti-removal monitoring device or bracelet has been described that is reliable, and that will not send in false alarms or false tampers, and will provide a simple installation procedure. This design eliminates all elements previously used in the prior art that caused such unnecessary problems.

Obviously, many modifications and variations of the present invention are possible in light of the above teachings. For example, a wedge may be substituted for the gear shaft (49) in a manner for moving the piston (46). Further, the tab end (146) could be modified such that it was widened and split longitudinally in such a manner as to be provided not only with the pins (99) on one split portion, but also with an opening formed in the other split portion for fitting over the diaphragm unit, the opening adapted to be vertically aligned with the diaphragm unit opening (117). Thus, upon engagement of the strap end (26') through the slot (98), itself widened if necessary the pins (99) could be connected as before and the opening in the split portion would receive the plunger (46'). Upon assembly of the modified device (20'), similar to (20), the plunger (46') would extend through so as to engage both ends of the strap. It is therefore to be understood that, within the scope of the appended claims, the invention may be practiced otherwise than as specifically described.

We claim:

1. A monitoring device for attachment to an object being monitored, and having electronic circuitry including a transmitter for transmitting a signal to a location remote from the device, the device comprising:

a housing;

switch means disposed within said housing;

an electrically conductive strap having opposite ends and of a length that allows it to be wrapped around the limb of an object being monitored, one end of said strap having means for receiving electrical energy;

a base for attachment to said housing and including first means for receiving and holding said one end of said strap below said housing;

said base including further second means for receiving an opposite end of said strap whereby a loop is formed by said strap, and including further third means mounted within said base having a first position and a second position, said third means extended through both said ends of said strap in said second position and engaging said switch means, said switch means not engaged by said third means in said first position.

2. The monitoring device of claim 1, and further wherein locking means is provided for insertion into said base to lock said third means into said first position.

3. The monitoring device of claim 2, and further wherein fourth means is provided for insertion into said base to move said third means away from said switch means from said second position to said first position.

4. The monitoring device of claim 3, and further wherein said housing has formed therein separate openings for receiving, respectively, said locking means and said fourth means, said locking means including an element extended into engagement with said third means to retain said third means in said first position.

5. The monitoring device of claim 2, and further wherein said third means includes a piston for engaging said switch means, and means within said base for biasing said piston toward said second position.

6. The monitoring device of claim 5, and further wherein said switch means includes a flexible membrane engaged by said piston in its said second position.

7. The monitoring device of claim 1, and further wherein a sealing means is applied to said strap one end electrical energy receiving means held by said first means whereby to seal said receiving means against the environment.

8. The monitoring device of claim 1, and further wherein said base includes an upper floor with a circular opening formed therein to receive said third means, and with said base first means including a pair of posts for engaging and holding said strap one end upon said upper floor.

9. The monitoring device of claim 8, and further wherein said strap includes a plurality of apertures formed therein in longitudinally spaced relation, each aperture adapted to be aligned with said base upper floor opening, said strap one end and said strap opposite end disposed within said body such that said strap one end has an aperture in alignment with a corresponding aperture in said strap opposite end and with said base upper floor opening, whereby said third means moves simultaneously through said opening and said aligned apertures from said first position to said second position.

10. The monitoring device of claim 9, and further wherein said base includes a cylinder formed therein for reciprocally receiving and guiding movement of said third means.

11. The monitoring device of claim 10, and further wherein said third means includes a spring biased piston movably mounted within said cylinder.

12. The monitoring device of claim 11, and further wherein said piston has gear teeth formed along one wall thereof, and with a fourth means including a gear shaft in engagement with said gear teeth, said fourth means extended into said housing for engagement of said gear shaft with said gear teeth.

13. A monitoring device for attachment to an object being monitored, having electronic circuitry including a transmitter for transmitting a signal to a location remote from the device, the device comprising:

a housing;

switch means disposed within said housing;

an electrically conductive strap having opposite ends and of a length that allows it to be wrapped around the limb of an object being monitored, one end of said strap having means for receiving electrical energy;

a base for attachment to said housing and including an upright piston, including further first means for receiving and holding said one end of said strap below said housing, and including still further second means for receiving an opposite end of said strap below said housing whereby a loop is formed by said strap, said piston extended through both ends of said strap received within said first means and said second means, respectively, said piston retaining said strap opposite end, and engaged with said switch means upon attachment of said housing with said base.

14. A monitoring device for attachment to an object being monitored, comprising:

a base having at least one upstanding post mounted on an upper face thereof;

an electrically conductive strap having opposite ends and of a length that allows it to be wrapped around the limb of an object being monitored, one end adapted to be placed over said base unit upper face, with said post extended through said one end, said opposite end provided with a tab having connecting pins;

an intermediate member of a size similar to said base and having an opening and a slot formed therein, said member having an upper face;

an electronic circuitry assembly for transmitting one or more signals to a location remote from the device, said assembly including at least one battery, and a pair of switches;

means for securing said assembly to said member upper face above said opening and said slot;

means forming a flexible diaphragm within said opening;

a cover of a size similar to said base and to said intermediate member and adapted to cover said circuitry assembly;

said strap opposite end insertable between said base and said member, with said tab extended through said slot and with said pins electrically connected into said assembly; and means for securing said cover, intermediate member and base together, whereby said post engages and extends said diaphragm unit into engagement with both said switches to activate said electronic circuitry assembly.

15. The monitoring device of claim 14 and including further means sealing said flexible diaphragm within said opening.

16. A monitoring device for attachment to an object being monitored and having electronic circuitry including a transmitter for transmitting one or more signals to a location remote from the device, the device comprising:

a base having at least one upstanding post mounted on an upper face thereof;

an electrically conductive strap having opposite ends and of a length that allows it to be wrapped around the limb of an object being monitored, one end adapted to be placed over said base unit upper face, with said post extended through said one end, said opposite end provided with a tab;

an intermediate member of a size similar to said base and having an opening and a slot formed therein, said member having an upper face;

means for securing said assembly to said member upper face above said opening and said slot;

means forming a flexible diaphragm within said opening;

a cover of a size similar to said base and to said intermediate member and adapted to cover said intermediate member;

said strap opposite end insertable between said base and said member, with said tab extended through said slot and exposed above said member upper face; and means for securing said cover, intermediate member and base together, whereby said post engages and extends said diaphragm unit above and disposed beyond said member upper face.

17. The monitoring device of claim 16 and including further means sealing said flexible diaphragm within said opening.

* * * * *